US012181166B2

(12) United States Patent
Haessig et al.

(10) Patent No.: US 12,181,166 B2
(45) Date of Patent: Dec. 31, 2024

(54) METHODS TO MONITOR AIR FILTER LIFE IN FAN MOTOR CONTROLLER AND APPARATUS FOR SAME

(71) Applicant: Evolution Controls Inc., Poway, CA (US)

(72) Inventors: David Lee Haessig, Poway, CA (US); Ronald Sai Kit Yip, Poway, CA (US); Roger Hort, Poway, CA (US)

(73) Assignee: Evolution Controls Inc., Poway, CA (US)

( * ) Notice: Subject to any disclaimer, the term of this patent is extended or adjusted under 35 U.S.C. 154(b) by 498 days.

(21) Appl. No.: 17/724,965

(22) Filed: Apr. 20, 2022

(65) Prior Publication Data

US 2022/0341614 A1 Oct. 27, 2022

Related U.S. Application Data

(60) Provisional application No. 63/177,734, filed on Apr. 21, 2021.

(51) Int. Cl.

| | |
|---|---|
| ***F24F 11/39*** | (2018.01) |
| ***F24F 7/007*** | (2006.01) |
| ***F24F 11/52*** | (2018.01) |
| ***F24F 11/88*** | (2018.01) |

(52) U.S. Cl.

CPC ..... *F24F 11/39* (2018.01); *F24F 7/007* (2013.01); *F24F 11/52* (2018.01); *F24F 11/88* (2018.01)

(58) Field of Classification Search

CPC ..... F24F 7/007
USPC ..... 454/310
See application file for complete search history.

(56) References Cited

U.S. PATENT DOCUMENTS

| | | | | |
|---|---|---|---|---|
| 6,448,896 | B1 * | 9/2002 | Bankus | F24F 11/52 340/607 |
| 6,993,414 | B2 * | 1/2006 | Shah | F24F 11/30 340/607 |
| 9,183,723 | B2 * | 11/2015 | Sherman | F24F 11/526 |
| 10,518,206 | B1 * | 12/2019 | Hingorani | B01D 46/0086 |
| 10,610,818 | B2 * | 4/2020 | Fox | F24F 11/00 |
| 10,670,488 | B2 * | 6/2020 | Alsaleem | F04B 51/00 |
| 2014/0190240 | A1 * | 7/2014 | He | H05K 7/20209 73/38 |
| 2018/0333667 | A1 * | 11/2018 | Maranville | B01D 46/521 |
| 2022/0203288 | A1 * | 6/2022 | Wenger | B01D 46/0036 |
| 2022/0290886 | A1 * | 9/2022 | Frenk | B01D 46/446 |

* cited by examiner

*Primary Examiner* — Avinash A Savani
*Assistant Examiner* — Dana K Tighe
(74) *Attorney, Agent, or Firm* — Weintraub Tobin; Eric Caligiuri

(57) ABSTRACT

A method and apparatus to monitor air filter life and motor usage in a forced air filtration system is disclosed. The forced air filtration system uses a constant volume (CV) motor to drive a fan or blower to force the air through the filter. The generated data allows the users to schedule air filter replacement and motor maintenance to maintain system performance and avoid interruption of normal operation due to equipment failure. The motor life monitoring may also be used by equipment manufacturers and users to track equipment life expectancy.

17 Claims, 7 Drawing Sheets

METHODS TO MONITOR AIR FILTER LIFE IN FAN MOTOR CONTROLLER AND APPARATUS FOR SAME

CROSS-REFERENCE TO RELATED APPLICATIONS

This application claims priority under 35 U.S.C. Section 119(e) to U.S. Provisional Patent Application No. 63/177,734, filed on Apr. 21, 2021, the entire disclosure of which is incorporated herein by reference.

FIELD OF THE INVENTION

The present invention relates generally to methods and apparatus to monitor air filter life based on motor output in forced air filtration systems.

BACKGROUND OF THE INVENTION

A forced air filtration system cleans air by passing it through a set of air filters before delivering the filtered air into a clean space. However, the air filters need to be replaced periodically to maintain the effectiveness in removing dust particles from the supply air. The motor, which is the heart of a forced air filtration system, also needs to be periodically maintained to avoid interrupting normal operation due to equipment failure.

Thus, there is a need for a maintenance notification system and process for a user to maintain a forced air filtration system in order to avoid deterioration of performance and loss of use due to motor failure, and to track equipment life expectancy.

BRIEF SUMMARY OF THE INVENTION

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

According to various embodiments, the invention and disclosure herein describes the system and method which can be used by a motor controller controlling a constant volume (CV) fan motor to determine air filter usage by monitoring the total volume of air flow through the air filter and the total time the air filter has been in service. The user is notified to replace the air filter when either the volume-based or time-based air filter usage exceeds the maximum recommended air filter life. The time-based filter life is based on the breaking down of the filter material due to aging while the air volume-based filter life is based on how much dust particles are trapped in the filter.

The invention also provides maintenance notification in advance for the user to maintain the forced air filtration system in order to avoid deterioration of performance and loss of use due to motor failure.

The disclosed invention also accumulates the total number of motor revolutions. The equipment manufacturer can schedule maintenance notifications for the motor based on the accumulated motor revolutions. The controller accumulates the total number of revolutions based on the revolutions per minute (RPM) feedback signal from the motor.

For example, in one embodiment, an air filter system comprises a constant volume fan motor; a signal indicative of revolutions per minute of the constant volume fan motor; a fan attached to the constant volume fan motor; a filter for filtering a dirty air stream, wherein the fan blows the dirty air stream through the filter; a notification output; a digital device connection for receiving a profile, wherein the profile comprises a plurality of values; a non-volatile memory for storing the profile; a motor controller connected to the non-volatile memory, wherein the motor controller receives the signal indicative of revolutions per minute from the constant volume fan motor; a control signal to control the constant volume fan motor, wherein the motor controller sends the control signal to the constant volume fan motor; wherein the motor controller monitors air flow through the filter and determines a value indicative of accumulated air flow through the filter; wherein the motor controller determines a value indicative of accumulated time in use of the filter; and wherein the motor controller uses the profile, the value indicative of accumulated air flow through the filter, the value indicative of accumulated time in use of the filter, and the signal indicative of revolutions per minute to monitor usage of the filter.

In this embodiment, the air filter system can further comprise wherein the non-volatile memory is integrated with the motor controller on the same integrated circuit; wherein one of the plurality of values of the profile comprises a maximum air volume based filter life value for the filter; wherein the maximum air volume based filter life value represents a number of days; wherein the motor controller triggers a replace filter notification after the value indicative of accumulated air flow through the filter exceeds the maximum air volume based filter life value for the filter; wherein the motor controller sends the replace filter notification to the notification output; wherein one of the plurality of values of the profile comprises a maximum time based filter life value for the filter; wherein the maximum time based filter life value represents a number of days; wherein the motor controller triggers a replace filter notification after the value indicative of accumulated time in use of the filter exceeds the maximum time based filter life value for the filter; wherein the motor controller sends the replace filter notification to the notification output; wherein one of the plurality of values of the profile comprises a maximum number of motor revolutions value for the constant volume fan motor; wherein the motor controller uses the revolution per minute signal to determine an accumulated revolution per minute value of the constant volume fan motor; wherein the motor controller triggers a motor maintenance notification after the accumulated revolution per minute value exceeds the maximum number of motor revolutions value; wherein the motor controller sends the motor maintenance notification to the notification output; wherein the filter comprises a pre-filter, a carbon filter, and a HEPA filter; wherein the control signal represents a percent of a maximum air flow rate for the constant volume fan motor; or wherein the constant volume fan motor comprises an electronically commutated motor.

DETAILED DESCRIPTION OF THE INVENTION

The following is a detailed description of embodiments to illustrate the principles of the invention. The embodiments are provided to illustrate aspects of the invention, but the invention is not limited to any embodiment. The scope of the invention encompasses numerous alternatives, modifications, and equivalents. Reasonable variation and modification are possible within the scope of the disclosure and drawings without departing from the spirit of the invention. The scope of the invention is limited only by the claims.

While numerous specific details are set forth in the following description to provide a thorough understanding of the invention, the invention may be practiced according to the claims without some or all of these specific details.

Various embodiments will be described in detail with reference to the accompanying drawings. Wherever possible, the same reference numbers are used throughout the drawings to refer to the same or like parts. References made to particular examples and implementations are for illustrative purposes and are not intended to limit the scope of the claims.

Figure 1:
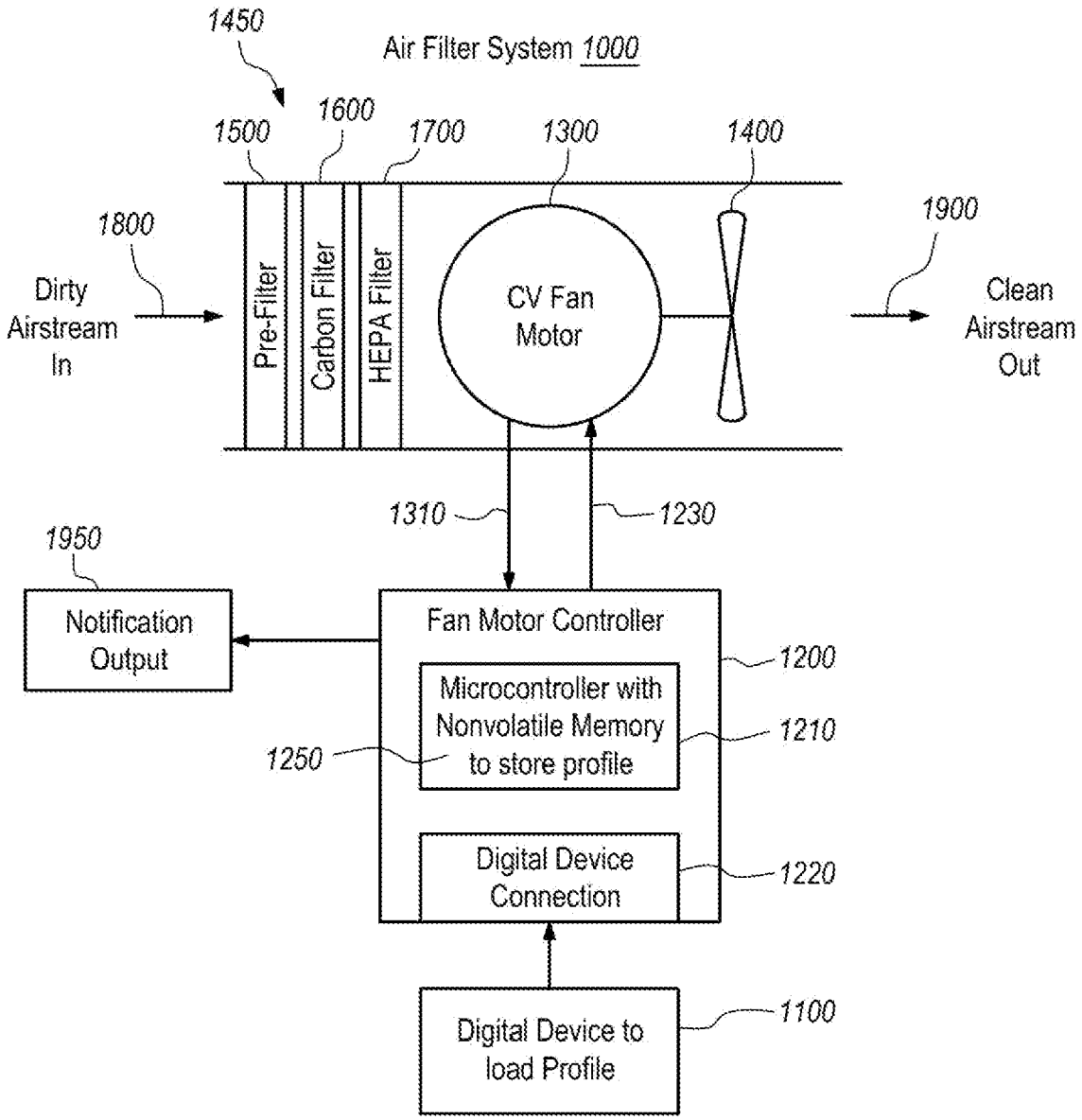
FIG. 1 illustrates an example embodiment of a diagram of an air filter system of the present invention.

FIG. 1 illustrates an example embodiment of a diagram of an air filter system 1000. Air filter system 1000 comprises a constant volume (CV) fan motor 1300 attached to a fan 1400 which draws in a dirty airstream 1800 and pushes a clean air stream 1900 out of the system. In one embodiment, CV fan motor 1300 comprises an electronically commutated (EC) motor. Air filter system 1000 cleans the dirty airstream 1800 by passing it through a filter 1450. In one embodiment, filter 1450 comprises a pre-filter 1500, a carbon filter 1600, and a HEPA filter 1700.

Air filter system 1000 also comprises notification output 1950. In one example embodiment, notification output 1950 comprises wireless communication, such as through Bluetooth or WIFI communication, to connect to a wirelessly connected device or display. In other embodiments, notification output 1950 can comprise notification through an attached display or other wired connection to a connected device or display.

Fan motor controller 1200 controls the air flow rate by sending a control signal 1230 to control the output of the CV fan motor 1300. The control signal 1230 is expressed as a percent of the maximum air flow rate programmed in the CV fan motor 1300. The CV fan motor 1300 returns a signal 1310 indicative of revolution per minute (RPM) of the CV fan motor 1300 to the fan motor controller 1200. The fan motor controller 1200 comprises a microcontroller 1210 and nonvolatile memory 1250 to store a profile, and a digital device connection 1220 to load the profile from an external digital device 1100.

In one embodiment, digital device 1100 downloads a profile which contains the recommended Maximum Air Volume Based Filter Life (AVBFL), Maximum Time Based Filter Life (TBFL) for filter 1450, and maximum number of motor revolutions to the fan motor controller 1200, which saves the values in nonvolatile memory 1250.

In one embodiment, AVBFL is configured in number of days, but in other embodiments could be configured in weeks, months, or years. In one embodiment, microcontroller 1210 in fan motor controller 1200 translates AVBFL to Air Volume Rate Hour (AVRHr) based on 100% air volume flow rate, using the following calculation: Maximum Air Volume Based Filter Life (AVBFL) in AVRHr=AVBFL*24 hours/day.

In one embodiment, Maximum Time Based Filter Life (TBFL) is also configured in number of days, but in other embodiments could be configured in weeks, months, or years. In one embodiment, microcontroller 1210 in fan motor controller 1200 translates TBFL to hours, using the following calculation: Maximum Time Based Filter Life in hours=TBFL days*24 hours/day.

The replace air filter notification is triggered when the accumulated AVRHr is larger than the maximum set AVRHr or when the accumulated TBFL hours is larger than the maximum set TBFL hours. Both AVBFL and TBFL can be independently enabled or disabled. The motor maintenance notification is triggered when the accumulated number of motor revolutions is larger than the maximum number of motor revolutions.

Figure 2:
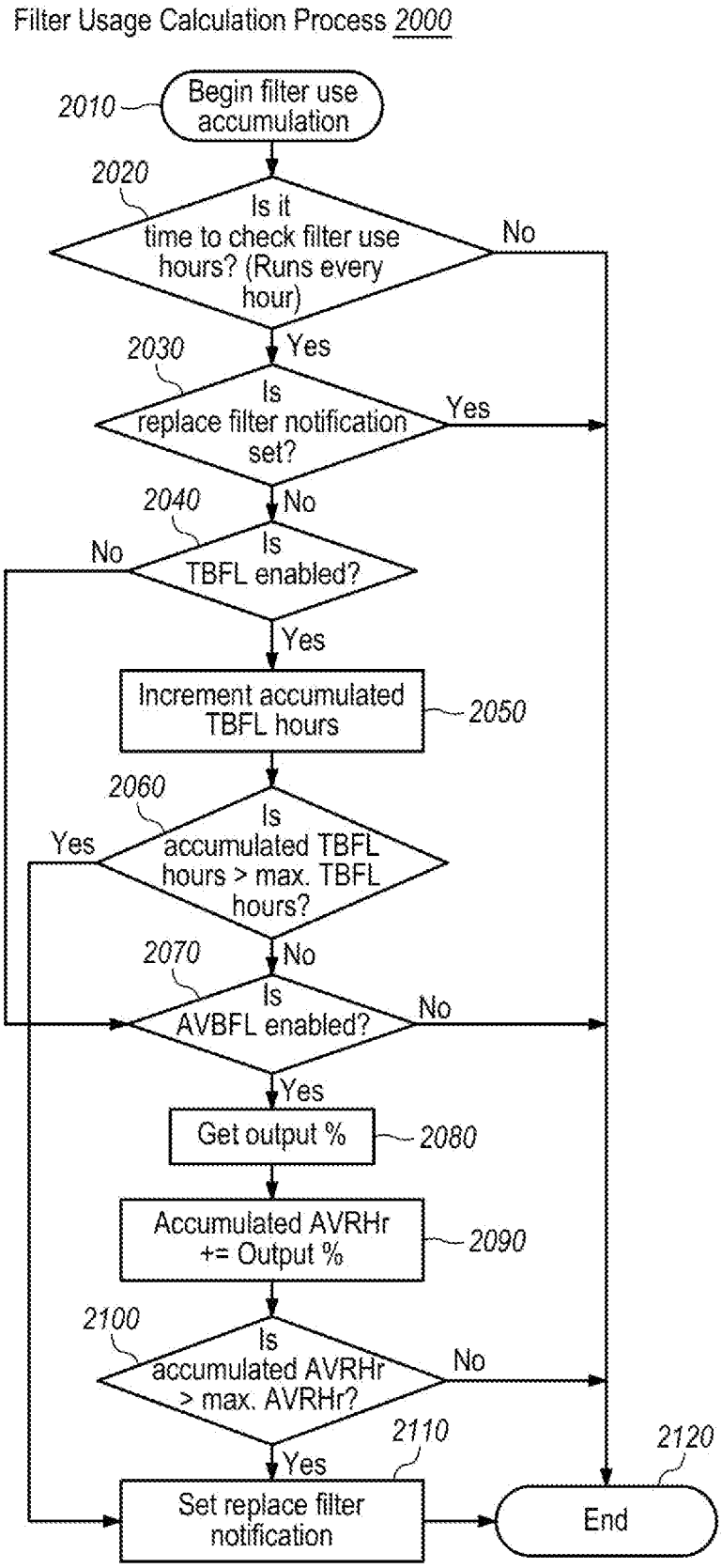
FIG. 2 illustrates an embodiment of an air filter usage calculation process of the present invention.

FIG. 2 illustrates an embodiment of air filter usage calculation process 2000. Air filter usage calculation process 2000 begins at step 2010 and then moves to step 2020. At step 2020, it is determined whether it is time to check the air filter usage. In one embodiment, the air filter usage is evaluated every hour. Thus, in this embodiment, air filter usage calculation process 2000 moves to step 2120 to end if it has been less than one hour since the last calculation. If it is time to calculate air filter usage, the process moves from step 2020 to step 2030 where it is checked whether the air filter replacement notification is set. If the air filter replacement notification is set, air filter usage calculation process 2000 moves to step 2120 to end.

In step 2030, if the replace air filter notification is not set, air filter usage calculation process 2000 moves to step 2040. In step 2040, TBFL is checked as to whether it is enabled. If TBFL is enabled, the air filter usage calculation process 2000 proceeds to step 2050 where the accumulated TBFL hours are incremented by one hour and then the process proceeds to step 2060. In step 2060, the total accumulated TBFL hours is compared against the manufacturer recommended maximum TBFL hours. If the accumulated TBFL hours is less than the maximum TBFL hours, air filter usage calculation process 2000 continues to step 2070 to start the AVBFL calculation. If the accumulated TBFL is larger than or equal to the maximum TBFL hours, the process proceeds to step 2110 where air filter replacement notification is triggered and then air filter usage calculation process 2000 moves to step 2120 to end.

In step 2040, if TBFL is disabled, air filter usage calculation process 2000 moves to step 2070 to start the AVBFL calculation. In step 2070, the AVBFL calculation is checked as to whether it is enabled. If it is enabled, the process moves to step 2080 where the current motor output is retrieved. The current motor output is proportional to AVRHr in the current hour, meaning it is proportional to what AVRHr was during the past hour.

The process then moves to step 2090 where the current AVRHr is added to the accumulated AVRHr. Then the process moves to step 2100 where the accumulated AVRHr is compared with the maximum AVRHr recommended by the manufacturer. If the accumulated AVRHr is less than maximum AVRHr, air filter usage calculation process 2000 moves to step 2120 to end. If it is larger than or equal to the maximum AVRHr, air filter usage calculation process 2000 triggers the air filter replacement notification 2110 and then moves to step 2120 to end.

Figure 3:
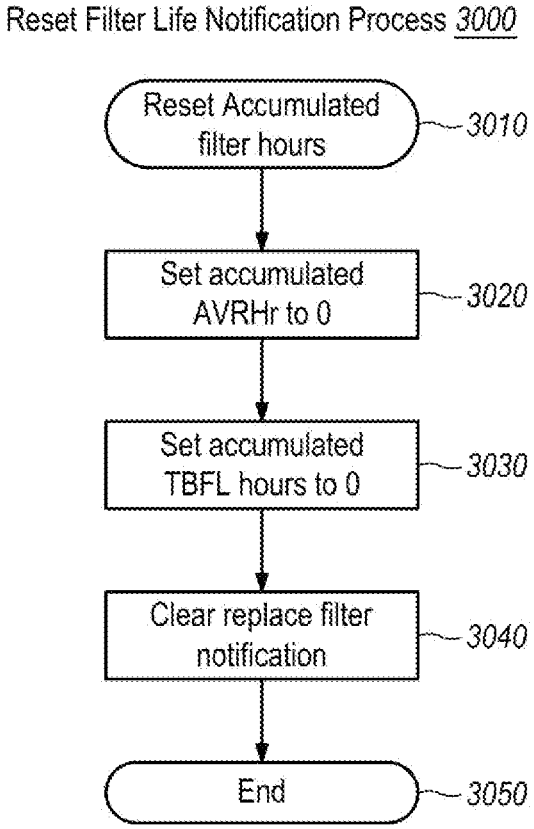
FIG. 3 illustrates an embodiment of a reset air filter life notification process of the present invention.

FIG. 3 illustrates an embodiment of a reset air filter life notification process 3000 for resetting accumulated air filter usage values after an air filter has been replaced. In reset air filter life notification process 3000, the user manually initiates the reset at step 3010. At step 3020, the accumulated AVRHr is reset to zero, and then the process moves to step 3030. At step 3030, the TBFL hours is reset to zero, and then the process moves to step 3040. At step 3040, the air filter replacement notification is cleared, and then the process moves to step 3050. Reset air filter life notification process 3000 then ends at step 3050.

Figure 4:
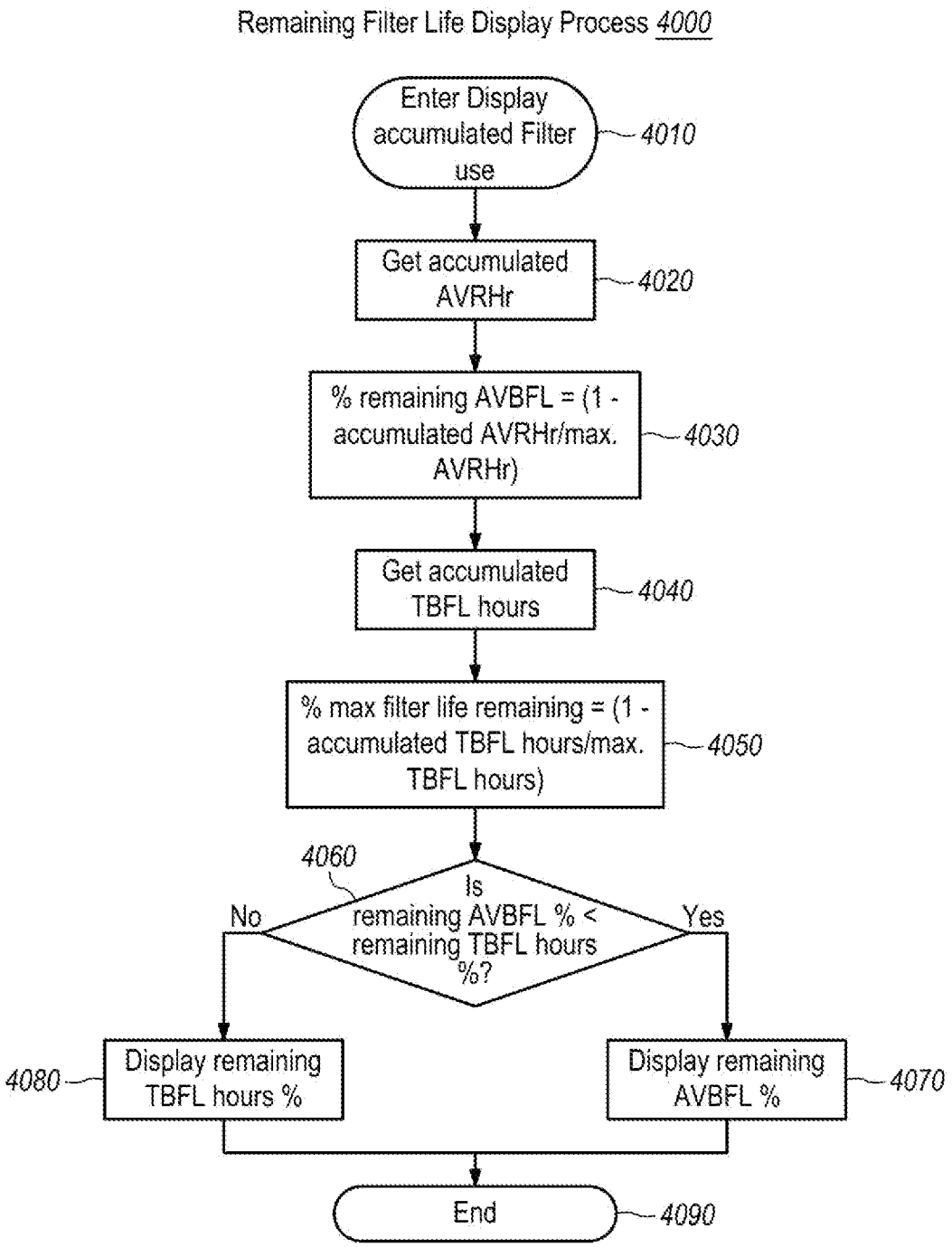
FIG. 4 illustrates an embodiment of a remaining air filter life display process of the present invention.

FIG. 4 illustrates an embodiment of a remaining air filter life display process 4000. Remaining air filter life display process 4000 begins at step 4010 and then proceeds to step 4020. At step 4020, the accumulated AVRHr is read from nonvolatile memory 1250, and then the process proceeds to step 4030. At step 4030, the accumulated AVRHr is used to calculate the remaining AVBFL as a percentage, where the percentage of remaining AVBFL=(1−accumulated AVRHr/maximum AVRHr).

Then the process proceeds to step 4040, where the accumulated TBFL is read from nonvolatile memory 1250. Then the process proceeds to step 4050 where the accumulated TBFL is used to calculate the remaining TBFL as a percentage, where the percentage of maximum air filter life remaining=(1−accumulated TBFL hours/maximum TBFL hours).

Next, the process proceeds to step 4060 where the percentage remaining AVBFL and percentage remaining TBFL are compared. If the percentage remaining AVBFL is less the percentage remaining TBFL, the process proceeds to step 4070 where the remaining AVBFL percentage is output through notification output 1950 to a connected device or display. In step 4060, if the percentage remaining AVBFL is greater than or equal to the percentage remaining TBFL, the process proceeds to step 4080 where the remaining TBFL percentage is output through notification output 1950 to a connected device or display. The remaining air filter life display process 4000 then moves to step 4090 and ends.

Figure 5:
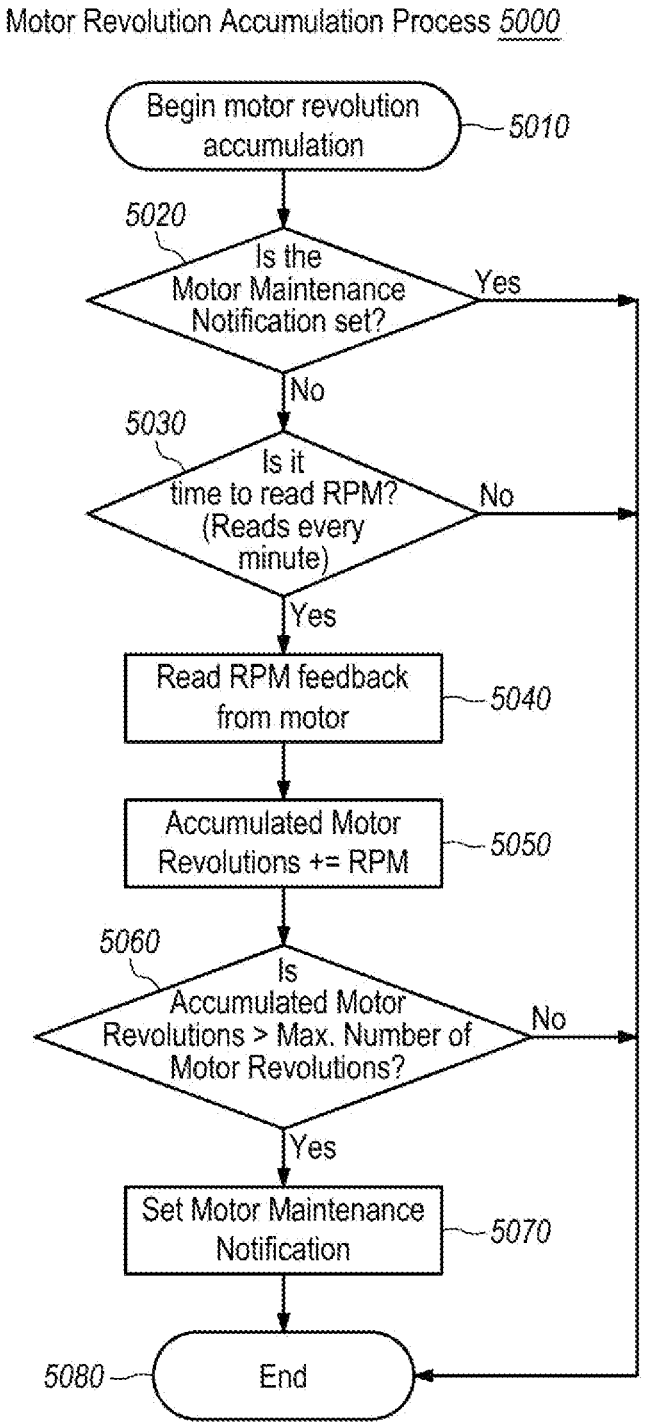
FIG. 5 illustrates an embodiment of a motor revolution accumulation calculation process of the present invention.

FIG. 5 illustrates an embodiment of a motor revolution accumulation calculation process 5000. Motor revolution accumulation calculation process 5000 begins at step 5010 and then proceeds to step 5020. At step 5020, motor revolution accumulation calculation process 5000 checks if the motor maintenance notification is set. If the motor maintenance notification is set, motor revolution accumulation calculation process 5000 moves to step 5080 and ends.

In step 5020, if the motor maintenance notification is not set, motor revolution accumulation calculation process 5000 moves to step 5030. At step 5030, it is determined whether it is time to read the motor revolutions per minute, or RPMs. In one embodiment, the motor revolutions per minute is read every minute by the fan motor controller 1200 by measuring the signal 1310 from the CV fan motor 1300.

If in step 5030, it is not time to read the motor RPMs, then the motor revolution accumulation calculation process 5000 moves to step 5080 and ends. In step 5030, if it is time to read the RPMs, the motor revolution accumulation calculation process 5000 moves to step 5040 where the RPM feedback is read by the fan motor controller 1200 by measuring the signal 1310 from the CV fan motor 1300. Then the process moves to step 5050 where the RPM feedback is added to the Accumulated Motor Revolutions, and the process moves to step 5060.

In step 5060, the Accumulated Motor Revolutions is compared with the Max Number of Motor Revolutions. If Accumulated Motor Revolutions is less than the Max Number of Motor Revolutions, motor revolution accumulation calculation process 5000 moves to step 5080 and ends. If Accumulated Motor Revolutions is greater than or equal to the Max Number of Motor Revolutions, the process moves to step 5070. In step 5070, the motor maintenance notification is set. Motor revolution accumulation calculation process 5000 then moves to step 5080 and ends.

Figure 6:
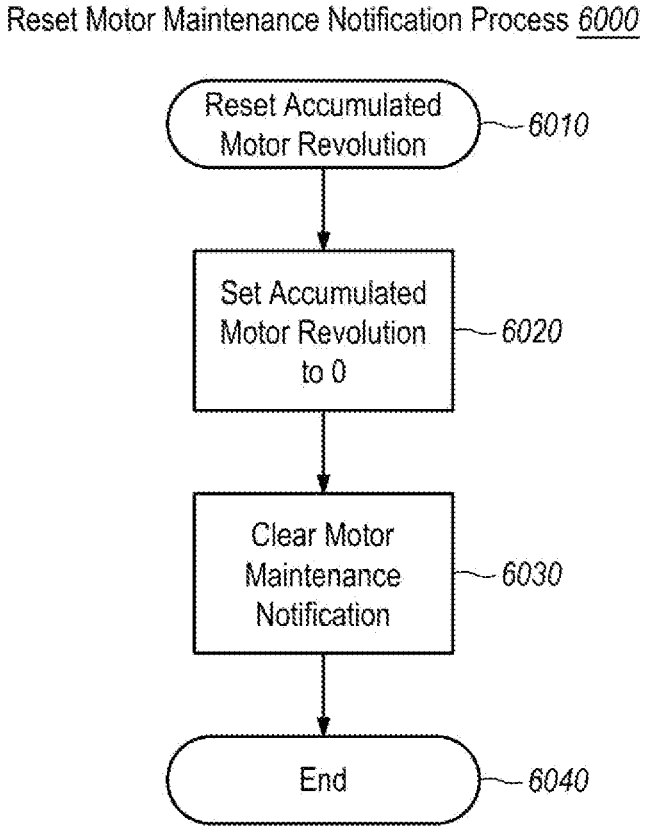
FIG. 6 illustrates an embodiment of a reset motor maintenance notification process of the present invention.

FIG. 6 illustrates an embodiment of a resetting the motor maintenance notification process 6000 for use after the CV fan motor 1300 has been serviced. A user manually initiates the motor maintenance notification process 6000 at step 6010, and the process proceeds to step 6020. At step 6020, the accumulated Motor Revolutions is reset to zero. Then the process moves to step 6030. At step 6030, the Motor Maintenance Notification is cleared. Motor maintenance notification process 6000 then moves to step 6040 and ends.

Figure 7:
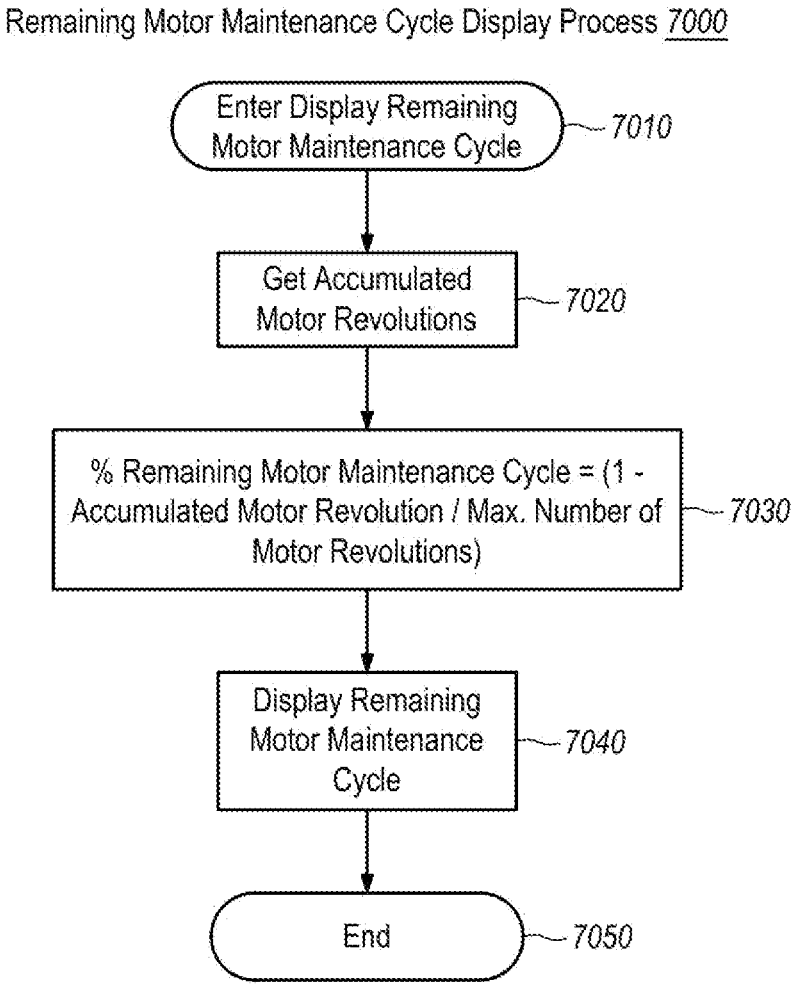
FIG. 7 illustrates an embodiment of a remaining motor maintenance cycle display process of the present invention.

FIG. 7 illustrates an embodiment of a remaining motor maintenance cycle display process 7000. Remaining motor maintenance cycle display process 7000 enters the display routine at step 7010 and then proceeds to step 7020. At step 7020, the Accumulated Motor Revolutions is retrieved from the non-volatile memory 1250, and then the process moves to step 7030. At step 7030, the Remaining Motor Maintenance Cycle as a percentage is calculated where the remaining percentage of the maximum number of revolutions=(1−Accumulated Motor Revolutions/Maximum Number of Motor Revolutions). Then the process moves to step 7040 and the percentage of the Remaining Motor Maintenance Cycle is output through notification output 1950 to a connected device or display. Remaining motor maintenance cycle display process 7000 then moves to step 7050 and ends.

What is claimed is:

1. An air filter system comprising:

a constant volume fan motor;

a signal indicative of revolutions per minute of the constant volume fan motor;

a fan attached to the constant volume fan motor;

a filter for filtering a dirty air stream, wherein the fan blows the dirty air stream through the filter;

a notification output;

a digital device connection for receiving a profile, wherein the profile comprises a plurality of values;

a non-volatile memory for storing the profile;

a motor controller connected to the non-volatile memory, wherein the motor controller receives the signal indicative of revolutions per minute from the constant volume fan motor;

a control signal to control the constant volume fan motor, wherein the motor controller sends the control signal to the constant volume fan motor;

wherein the motor controller monitors air flow through the filter and determines a value indicative of accumulated air flow through the filter;

wherein the motor controller determines a value indicative of accumulated time in use of the filter; and wherein the motor controller uses the profile, the value indicative of accumulated air flow through the filter, the value indicative of accumulated time in use of the filter, and the signal indicative of revolutions per minute to monitor usage of the filter.

2. The air filter system of claim 1 wherein the non-volatile memory is integrated with the motor controller on the same integrated circuit.

3. The air filter system of claim 1 wherein one of the plurality of values of the profile comprises a maximum air volume based filter life value for the filter.

4. The air filter system of claim 3 wherein the maximum air volume based filter life value represents a number of days.

5. The air filter system of claim 3 wherein the motor controller triggers a replace filter notification after the value indicative of accumulated air flow through the filter exceeds the maximum air volume based filter life value for the filter.

6. The air filter system of claim 5 wherein the motor controller sends the replace filter notification to the notification output.

7. The air filter system of claim 1 wherein one of the plurality of values of the profile comprises a maximum time based filter life value for the filter.

8. The air filter system of claim 7 wherein the maximum time based filter life value represents a number of days.

9. The air filter system of claim 7 wherein the motor controller triggers a replace filter notification after the value indicative of accumulated time in use of the filter exceeds the maximum time based filter life value for the filter.

10. The air filter system of claim 9 wherein the motor controller sends the replace filter notification to the notification output.

11. The air filter system of claim 1 wherein one of the plurality of values of the profile comprises a maximum number of motor revolutions value for the constant volume fan motor.

12. The air filter system of claim 11 wherein the motor controller uses the revolution per minute signal to determine an accumulated revolution per minute value of the constant volume fan motor.

13. The air filter system of claim 12 wherein the motor controller triggers a motor maintenance notification after the accumulated revolution per minute value exceeds the maximum number of motor revolutions value.

14. The air filter system of claim 13 wherein the motor controller sends the motor maintenance notification to the notification output.

15. The air filter system of claim 1 wherein the filter comprises a pre-filter, a carbon filter, and a HEPA filter.

16. The air filter system of claim 1 wherein the control signal represents a percent of a maximum air flow rate for the constant volume fan motor.

17. The air filter system of claim 1 wherein the constant volume fan motor comprises an electronically commutated motor.

* * * * *